US009596888B2

(12) United States Patent
Rogers

(10) Patent No.: US 9,596,888 B2
(45) Date of Patent: Mar. 21, 2017

(54) BABY WRAP

(71) Applicant: Theresa Rogers, Douglasville, GA (US)

(72) Inventor: Theresa Rogers, Douglasville, GA (US)

( * ) Notice: Subject to any disclaimer, the term of this patent is extended or adjusted under 35 U.S.C. 154(b) by 3 days.

(21) Appl. No.: 14/809,351

(22) Filed: Jul. 27, 2015

(65) Prior Publication Data

US 2016/0037827 A1 Feb. 11, 2016

Related U.S. Application Data

(60) Provisional application No. 62/034,612, filed on Aug. 7, 2014.

(51) Int. Cl.

| | |
|---|---|
| ***A41B 13/06*** | (2006.01) |
| ***A47D 13/02*** | (2006.01) |
| ***A47G 9/08*** | (2006.01) |

(52) U.S. Cl.

CPC ..... *A41B 13/06* (2013.01); *A47D 13/02* (2013.01); *A47G 9/083* (2013.01)

(58) Field of Classification Search

CPC ..... A47D 13/08; A47D 13/00; A47D 13/02; A47D 13/025; A61G 1/003; A61G 1/048; A61G 1/01; A41B 13/06; A41B 13/065; A47G 9/083

See application file for complete search history.

(56) References Cited

U.S. PATENT DOCUMENTS

| | | | | | |
|---|---|---|---|---|---|
| 1,462,897 | A * | 7/1923 | Barto | A47D 13/02 | 294/140 |
| 2,804,249 | A * | 8/1957 | Manalo | A47D 13/02 | 224/158 |
| 3,968,911 | A * | 7/1976 | Haas | A47D 15/001 | 224/158 |
| 4,254,900 | A * | 3/1981 | Wheeler | A41B 13/06 | 224/158 |
| 5,243,724 | A * | 9/1993 | Barnes | A41B 13/06 | 2/69.5 |
| 2012/0005829 | A1* | 1/2012 | Waters | A47D 7/00 | 5/420 |

(Continued)

OTHER PUBLICATIONS

Snugglebundl [online], [retrieved on Mar. 30, 2014], Retrieved from the internet: <URL: (http://www.snugglebundl.co.uk)>.

*Primary Examiner* — Nicholas Polito
*Assistant Examiner* — Amanda L Miller

(57) ABSTRACT

Implementations if a baby wrap are provided. In some implementations, the baby wrap may be used to wrap, lift, and/or transport a baby therein. In some implementations, the baby wrap may be configured to support the baby's head, neck, and/or spine during use. In some implementations, the baby wrap may be used to provide a warm, clean, dry, and/or soft surface on which a baby may be placed. In some implementations, the baby wrap may be used for any other purpose for which a typical blanket may be used. In some implementations, the baby wrap comprises one or more layers of fabric. In some implementations, the baby wrap may have three or more handles. In some implementations, the baby wrap may have a pocket thereon. In some implementations, each handle may comprise an opening that extends through the one or more layers of fabric.

19 Claims, 7 Drawing Sheets

(56) References Cited

U.S. PATENT DOCUMENTS

| | | | | |
|---|---|---|---|---|
| 2012/0311762 | A1* | 12/2012 | Aiken | A41B 13/06 2/69.5 |
| 2014/0150159 | A1* | 6/2014 | Alluna | A47D 13/02 2/69.5 |
| 2015/0182043 | A1* | 7/2015 | Vickerman | A47D 15/008 5/494 |

* cited by examiner

BABY WRAP

CROSS REFERENCE TO RELATED APPLICATION

This application claims the benefit of U.S. Patent Application Ser. No. 62/034,612, which was filed on Aug. 7, 2014, and is incorporated herein by reference in its entirety.

TECHNICAL FIELD

This disclosure relates to implementations of a baby wrap.

BACKGROUND

Babies are often held in the arms of a caregiver to comfort the child and/or to feed the child. A blanket may be positioned between the caregiver and the baby while holding the child to protect the caregiver's clothes from body fluids and/or to provide a clean surface against which the child may rest. A blanket also may be used to wrap a baby thereby providing both warmth and security. Wrapping a baby in a blanket may also sooth the baby and assist with lulling the baby to sleep. Unfortunately, when the caregiver moves to reposition the baby to lie the baby down in a crib, for example, the child may wake.

The Snugglebundl® (http://www.snugglebundl.co.uk/) is an example lifting wrap used to help move a baby without waking them. The Snugglebundl® is a wearable wrap having a hood thereon and two handles attached to the wrap on its sides to facilitate lifting a baby secured therein. The wrap is contoured about the edges to cover portions of the baby (e.g., the head and feet) when the baby is lying on the wrap. The handles are secured together using a tie.

However, the Snugglebundl® wrap has several disadvantages. First, due to its construction, it is not reversible. Thus, for example, if one side of the wrap becomes soiled, the other side cannot be used. Second, no handles are provided at the top and bottom of the wrap to provide additional stability during movement of the baby. Third, the tie provided to secure the handles together may become unraveled during use allowing the opening of the wrap to fall away from the baby. This may awaken the baby unexpectedly. Fourth, the contoured edges prevent the wrap from lying flat like a typical blanket and thus limits it use. Fifth, the construction of the wrap, including the contoured edges and handles may increase the cost to manufacturer.

DETAILED DESCRIPTION

Implementations of a baby wrap are provided. In some implementations, the baby wrap may be used to wrap, lift, and/or transport a baby therein. In some implementations, the baby wrap may be configured to support the baby's head, neck, and/or spine during use. In some implementations, the baby wrap may be used to provide a warm, clean, dry, and/or soft surface on which a baby may be placed. In some implementations, the baby wrap may be used for any other purpose for which a typical blanket may be used.

In some implementations, the baby wrap comprises one or more layers of fabric. In some implementations, the baby wrap may have three or more handles. In some implementations, the baby wrap may have a pocket thereon. In some implementations, the side edges of the baby wrap may taper between sides. In some implementations, the side edges may be curved.

In some implementations, each handle may comprise an opening that extends through the one or more layers of fabric.

Figure 1A:
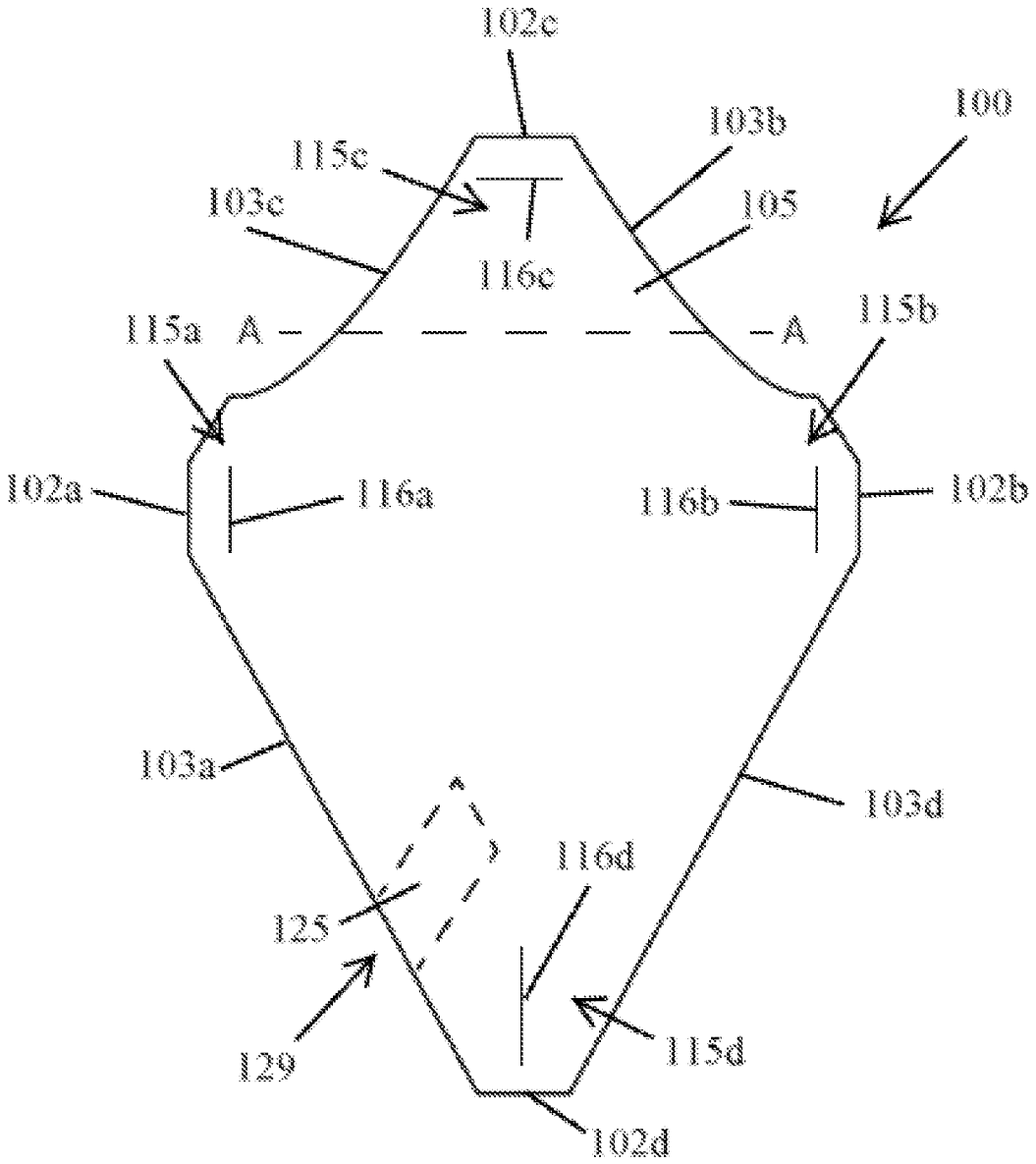
FIGS. 1A and 1B illustrate an example implementation of a baby wrap according to the principles of the present disclosure.
Figure 1B:
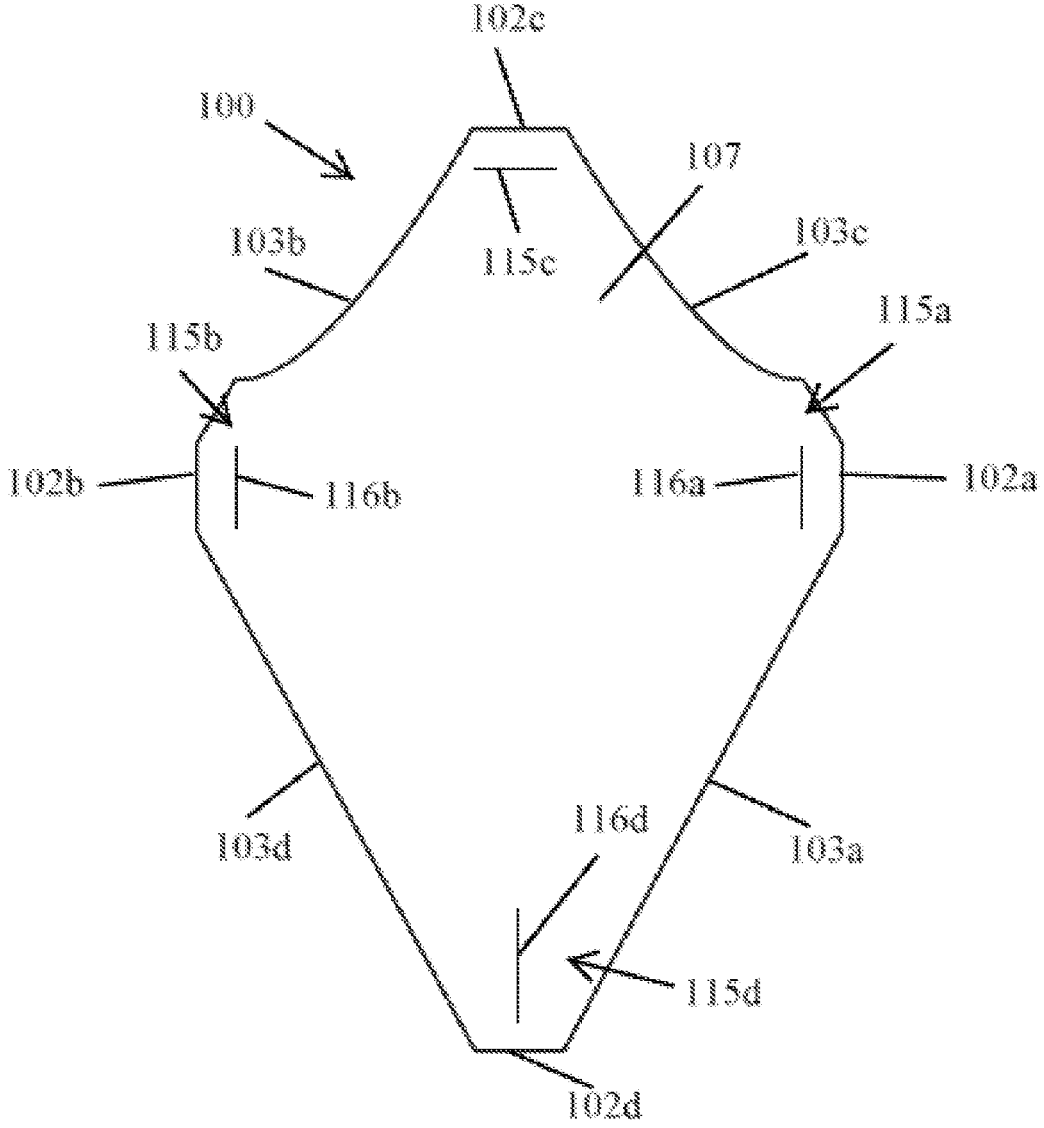

FIGS. 1A and 1B illustrate an example implementation of a baby wrap 100 according to the principles of the present disclosure. In some implementations, the baby wrap 100 may be used to wrap, lift, and/or transport a baby therein. In some implementations, the baby wrap 100 may be configured to support the baby's head, neck, and/or spine during use. In some implementations, the baby wrap 100 may be used to provide a warm, clean, dry, and/or soft surface on which a baby may be placed. In some implementations, the baby wrap 100 may be used for any other purpose for which a typical blanket may be used.

Figure 2:
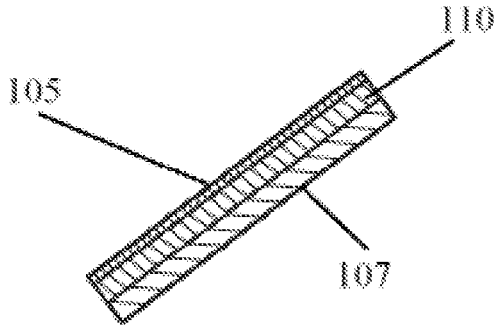
FIG. 2 illustrates a side cutaway view taken along lines A-A shown in FIG. 1A.

In some implementations, as shown in FIG. 2, the baby wrap 100 may comprise a first layer 105, a second layer 107, and a third layer of fabric 110. In some implementations, the baby wrap 100 may have four handles 115*a*, 115*b*, 115*c*, 115*d* (collectively 115). In some implementations, as shown in FIG. 1A, the baby wrap 100 may have a pocket 125.

As shown in FIG. 1A, in some implementations, the baby wrap 100 may have a left side 102*a*, a right side 102*b*, a top side 102*c*, and a bottom side 102*d*. In some implementations, the baby wrap 100 may have four side edges 103*a*, 103*b*, 103*c*, 103*d* (collectively 103).

In some implementations, a side edge 103*c* may extend between the top side 102*c* and the left side 102*a* of the baby wrap 100.

In some implementations, a side edge 103*b* may extend between the top side 102*c* and the right side 102*b* of the baby wrap 100.

In some implementations, a side edge 103*a* may extend between the left side 102*a* and the bottom side 102*d* of the baby wrap 100.

In some implementations, a side edge 103*d* may extend between the right side 102*b* and the bottom side 102*d* of the baby wrap 100.

In some implementations, one or more of the side edges 103 may taper (see, e.g., 103*a, b, c, d* of FIG. 1A) such that the baby wrap 100 reduces in width towards the top side 102*c* and/or bottom side 102*d*. In some implementations, one or more of the side edges 103 may be curved (see, e.g., 103*b, c* of FIG. 1A).

As shown in FIGS. 1A and 1B, in some implementations, each handle 115*a*, 115*b*, 115*c*, 115*d* may comprise an opening 116*a*, 116*b*, 116*c*, 116*d* (collectively 116), respectively, that extends through the layers of fabric 105, 107, 110 (see, e.g., FIGS. 1A and 1B). The handles 115 may be used to position and/or lift the baby wrap 100 during use.

In some implementations, an opening 116 may be positioned adjacent the top side 102*c*, the bottom side 102*d*, the left side 102*a*, and/or the right side 102*b* of the baby wrap 100 (see, e.g., FIG. 1A). In some implementations, one or more of the openings 116 may be positioned adjacent any portion of the perimeter of the baby wrap 100. In some implementations, the openings 116 may be positioned at any location on the baby wrap 100 that facilitates the use thereof.

In some implementations, the openings 116 may be configured to receive a portion of a user's hand therein. In some implementations, the openings 116 may be the same length and/or width. In some implementations, the openings 116 may not be the same length and/or width.

In some implementations, the opening 116*d* of handle 115*d* may be configured to allow a portion of the baby wrap 100 comprising the openings 116*a* and 116*b*, when gathered together, to be inserted therethrough (discussed in detail below).

In some implementations, the openings 116 may be vertically oriented (see, e.g., FIG. 1A, openings 116*a*, 116*b*, 116*d*). In some implementations, the openings 116 may be horizontally oriented (see, e.g., FIG. 1A, opening 116*c*).

In some implementations, the openings 116 of the handles 115 may not extend through the layers of fabric 105, 107, 110. In some implementations, the baby wrap may have more than four or less than four openings 116 thereon (e.g., opening 116*c* could be omitted).

In some implementations, the three layers 105, 107, 110 of fabric may be secured together by any method known to those of ordinary skill in the art. In some implementations, the baby wrap 100 may be assembled with more than three layers of fabric or less than three layers of fabric. For example, in some implementations, the baby wrap 100 may be assembled from one layer of material having a first side and second side.

As shown in FIG. 1A, in some implementations, a pocket 125 may be positioned between the first layer 105 and the third layer 110 of fabric. In some implementations, the pocket 125 may be positioned between the first layer 105 and the second layer 107 of fabric. In some implementations, the pocket 125 may be positioned on the exterior side of the first layer 105 and/or second layer 107 of fabric.

In some implementations, the opening 129 of the pocket 125 may be secured closed through the use of snaps. In some implementations, the opening 129 of the pocket 125 may be secured closed through the use of fastening means such as buttons, hook and loop fasteners (e.g., Velcro®), magnets or other reclosable fasteners or any other attachment or fastening technology existing or developed in the future. In some implementations, the pocket 125 may be configured to receive and contain therein items such as pacifiers, teething gel, thermometer, medication, and/or other items a caregiver may want to keep close to hand. In some implementations, the baby wrap 100 may include two or more pockets.

Figure 3A:
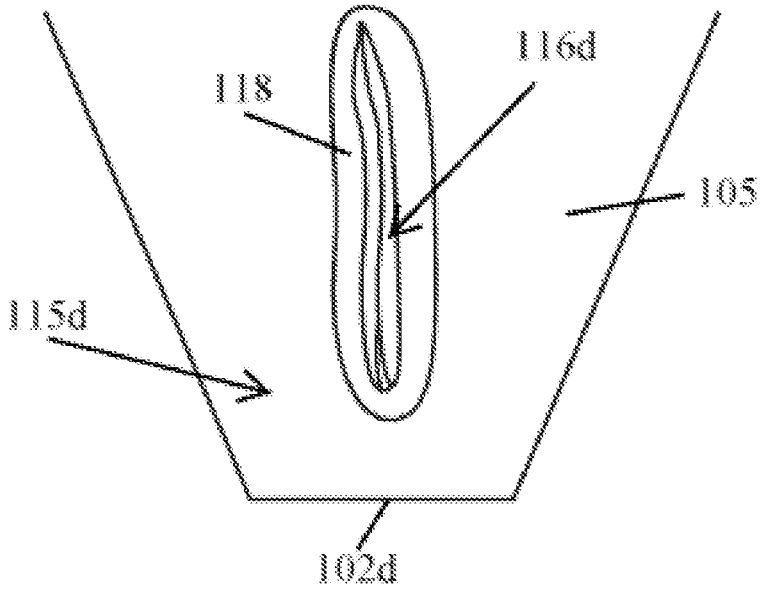
FIGS. 3A and 3B illustrate a handle reinforced with a binding.
Figure 3B:
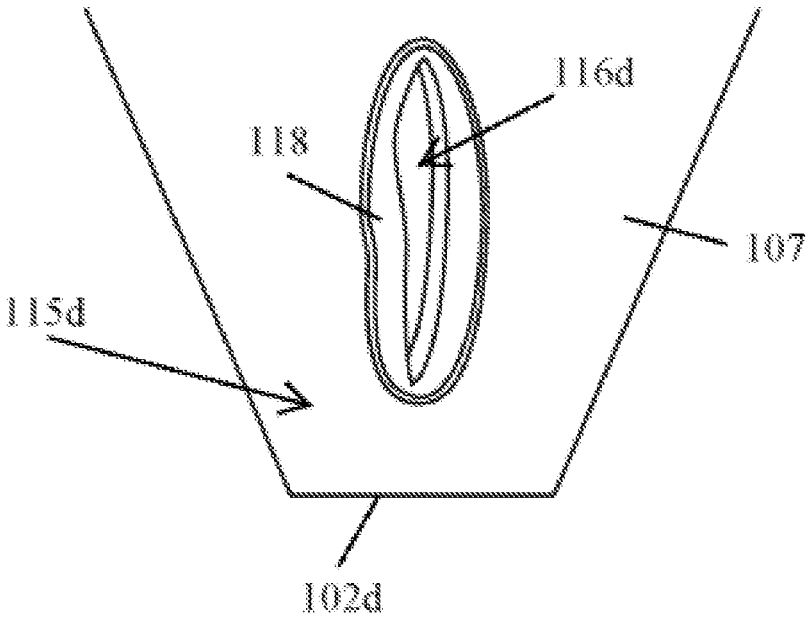

As shown in FIGS. 3A and 3B, in some implementations, the openings 116 of each handle 115 may be reinforced with a binding 118. In this way, an opening 116 may be prevented from ripping when the baby wrap 100 is used to lift a child. In some implementations, the openings 116 may be reinforced against tearing and/or ripping using any method currently known or developed in the future by one of ordinary skill in the art.

In some implementations, the layers of fabric 105, 107, 110 may be cotton and/or microfiber. In some implementations, the layers of fabric may be a mesh material suitable for use in water. In this way, the baby wrap may allow water to drain therefrom when used to lift the baby out of a tub, pool, or other water containing apparatus. In some implementations, the layers of fabric 105, 107, 110 may be any synthetic, semi-synthetic, or natural fiber, or combination thereof, suitable for use as part of a baby wrap 100. In some implementations, the first layer 105, the second layer 107, and/or the third layer 110 of fabric may each be manufactured from the same material. In some implementations, the first layer 105, the second layer 107, and/or the third layer 110 of fabric may each be manufactured from different materials. In some implementations, the first layer 105, the second layer 107, and/or the third layer 110 of fabric may be manufactured from a combination of materials.

In some implementations, the baby wrap 100 may be configured to lay flat thereby providing a generally planar surface when positioned on a flat surface. In this way, both sides of the baby wrap 100 may be used interchangeably.

In some implementations, both of the outside fabric layers 105, 107 of the baby wrap 100 may provide a suitable surface onto which the baby may be laid. In this way, the baby wrap 100 may be reversible.

Figure 4A:
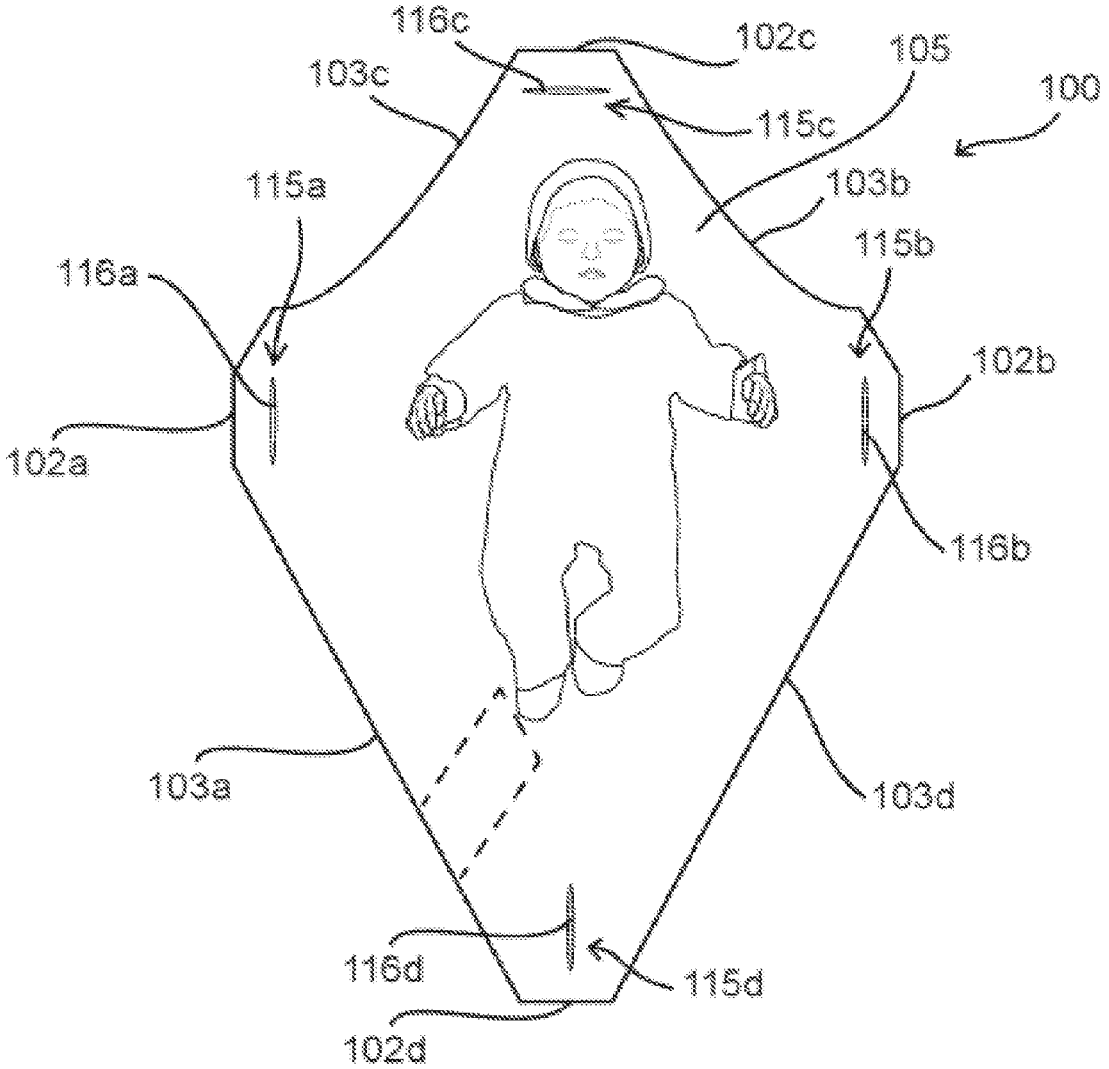
FIGS. 4A-4C illustrate an example method of using the baby wrap shown in FIGS. 1A and 1B.
Figure 4B:
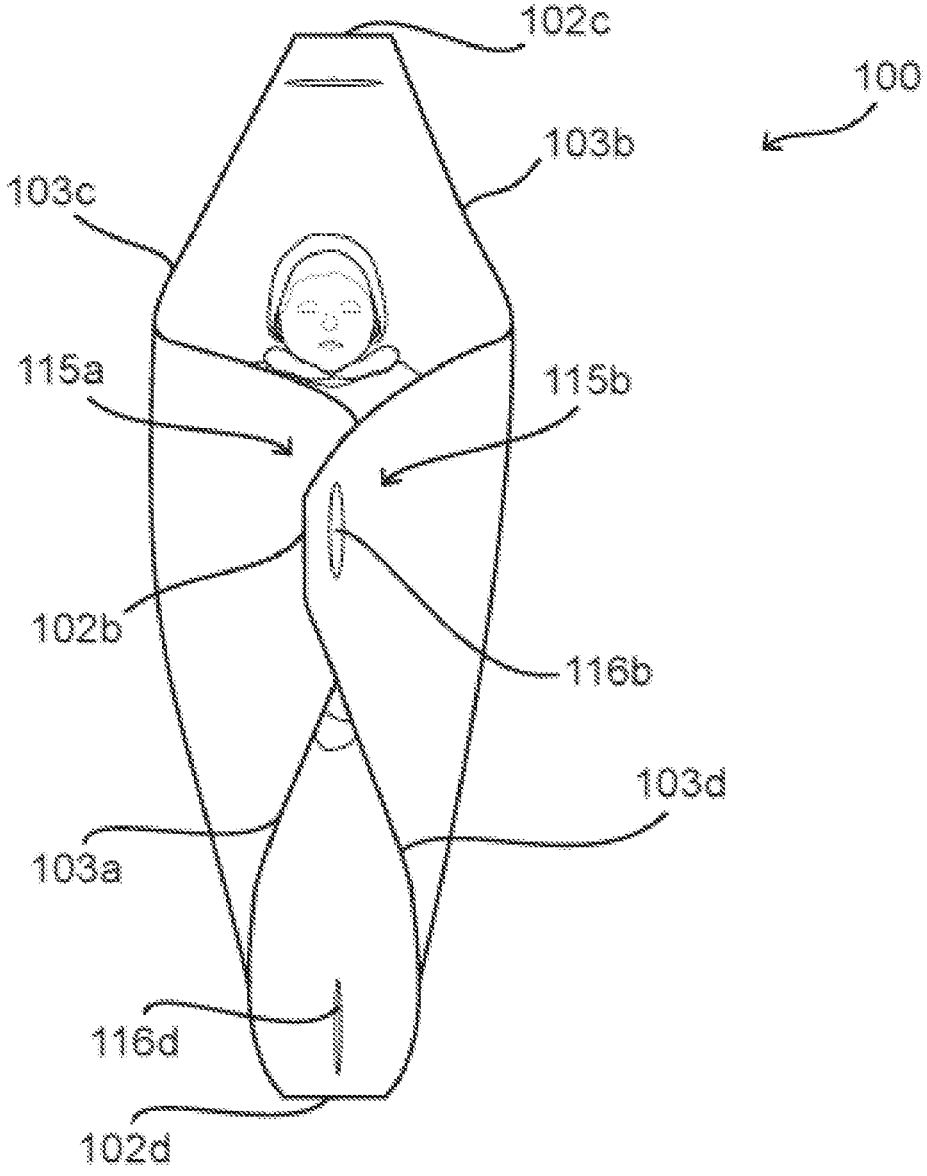
Figure 4C:
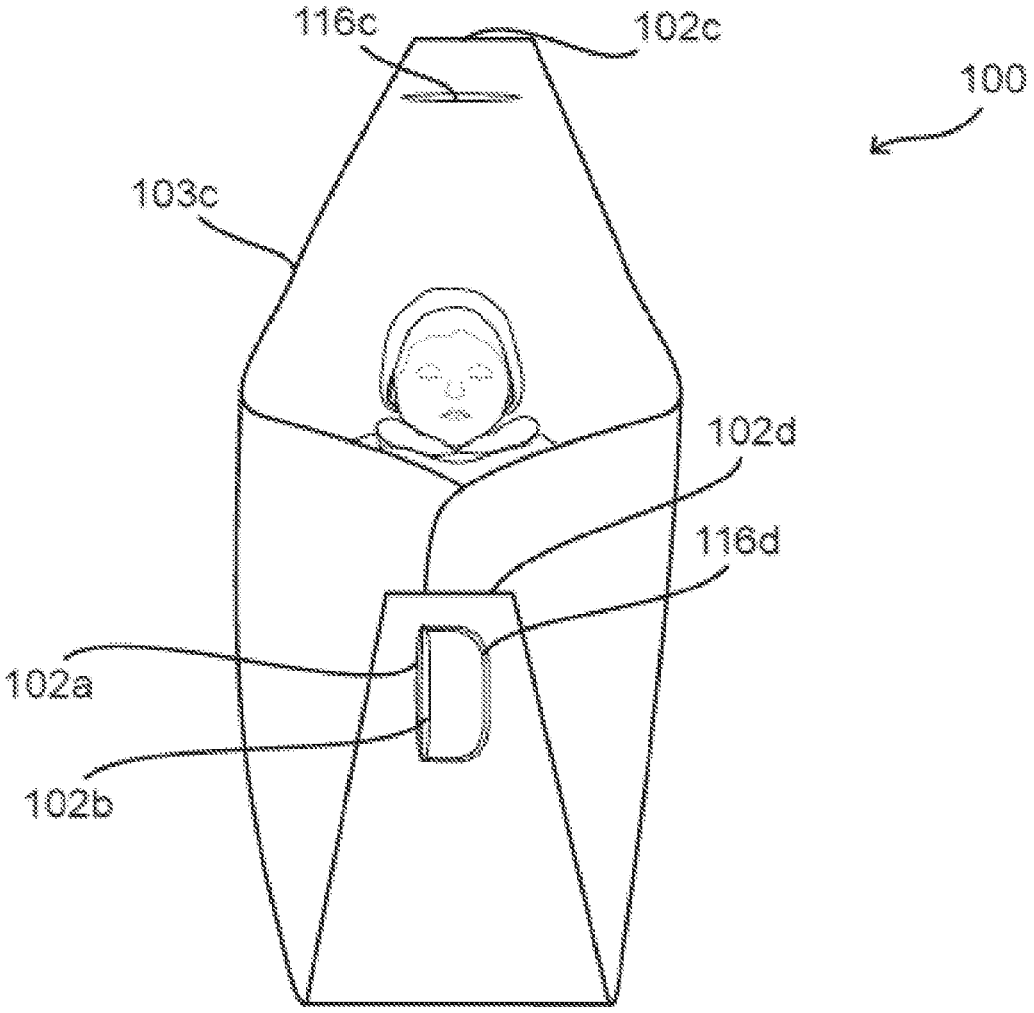

FIGS. 4A-4C illustrate an example method of using the baby wrap 100. As shown in FIG. 4A, the baby wrap 100 may be initially spread out on a surface (e.g., on the floor, changing table, mattress, or any other suitable surface). In some implementations, the baby wrap 100 may be initially spread out on an object (e.g., across a caregiver body while sitting, a car seat, or any other suitable object).

As shown in FIGS. 4A-4C, the baby then may be positioned on the baby wrap 100. In some implementations, the baby may be faced down on the baby wrap 100. In some implementations, the baby may be faced up on the baby wrap 100. In some implementations, the baby is position so that the baby's head is lying near a top side 102*c* of the baby wrap 100. In some implementations, the baby is positioned so that the baby is in the approximate center of the baby wrap 100. In some implementations, the chest of the baby is positioned in line with the openings 116*a* and 116*b* (see, e.g., FIG. 4A). In some implementations, the baby may be positioned in any suitable location.

Next, as shown in FIG. 4B, the handles 115*a*, 115*b* adjacent the left side 102*a* and right side 102*b*, respectively, of the baby wrap 100 are gathered together over the baby.

Then, as shown in FIG. 4C, in some implementations, the handle 115*d* adjacent the bottom side 102*d* of the baby wrap 100 is pulled up toward the gathered handles 115*a*, 115*b*. Then a portion of the gathered handles 115*a*, 115*b* are inserted through the opening 116*d* of the handle 115*d*. In some implementations, the portion of the gathered handles 115*a*, 115*b* that are inserted through the opening 116*d* of the handle 115*d* includes the openings 116*a* and 116*b*. With the openings 116*a* and 116*b* of the handles 115*a* and 115*b* extending through the opening 116*d* of handle 115*d* and the handles 115*a* and 115*b* being encircled by the opening 116*d*, a three sided enclosure has been formed about the baby. Furthermore, the user can grasp both handles 115*a* and 115*b* by inserting the user's fingers through the openings 116*a* and 116*b* of the handles 115*a* and 115*b* to lift and/or transport the baby.

In some implementations, the caregiver may support the baby's head by grasping the handle 115*c* through the opening 116*c* located adjacent the top side 102*c* of the baby wrap 100 and lifting the handle 115*c* to a desired position to support the baby's head.

To lay down a baby wrapped in the baby wrap 100, in some implementations, the baby wrap 100 may be initially lowered onto the desired surface (e.g., crib, mattress, changing table, car seat, floor, etc.). In some implementations, the caretaker may then release both handles 115*a* and 115*b* and pull them back through the opening 116*d* of the handle 115*d* located adjacent the bottom side 102*d* of the baby wrap 100.

Figure 5:
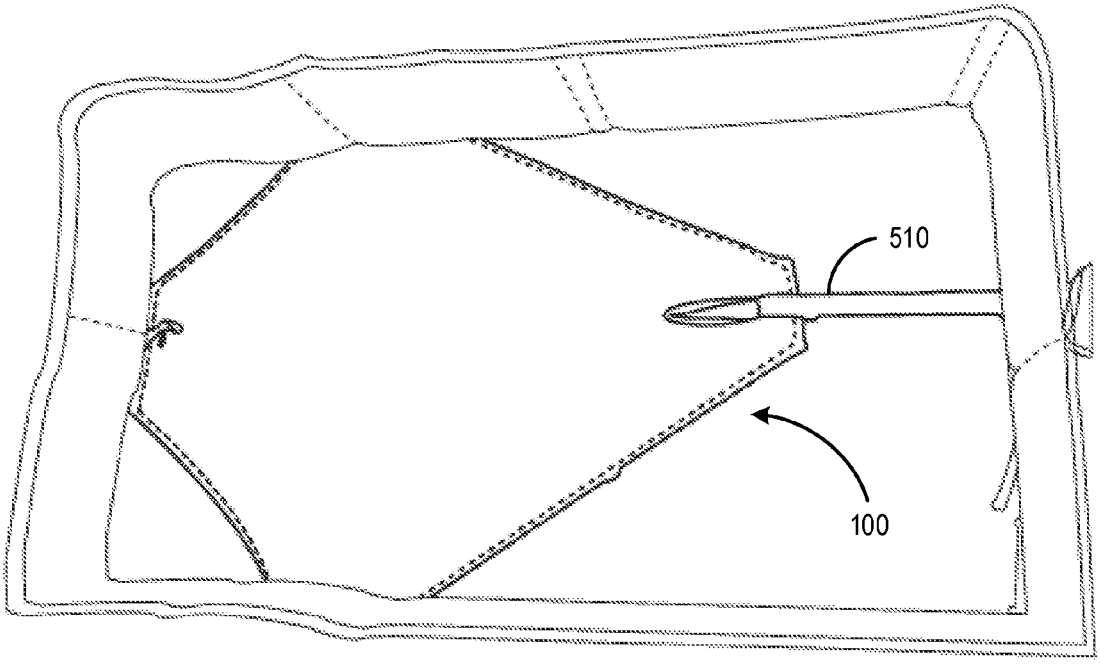
FIG. 5 illustrates an example method of using a baby wrap according to the principles of the present disclosure.

In some implementations, the left side 102*a*, right side, 102*b*, top side 102*c*, and/or bottom side 102*d* of the baby wrap 100 may then be spread out and, in some implementations, tucked away (e.g., under a crib-sized mattress) as shown in FIG. 5. In this way, the limbs of the baby may be prevented from getting tangled in one of the openings of the handles 115. In some implementations, if the baby wrap 100 is too small such that at least one side (e.g., 102*a, b, c*, or *d*) cannot be tucked away, then for each side (102*a, b, c, d*) desired to be secured, one end of an attachment (see, e.g., attachment 510) may be secured to the at least one side of the baby wrap 100. In some implementations, the attachment may be a strip of material. In some implementations, the attachment may be any suitable attachment. In some implementations, the attachment may be removably secured to the side of the baby wrap using fastening means such as buttons, hook and loop fasteners (e.g., Velcro®), magnets or other reclosable fasteners or any other attachment or fastening technology existing or developed in the future. In some implementations, an end of the attachment may be inserted through the opening (e.g., 116*a, b, c, d*) near a side and then secured to itself thereby forming a closed loop around the opening. Once one end of an attachment is secured to the side of the baby wrap, the other end of the attachment may be tucked away (e.g., under a mattress) as shown in FIG. 5. In this way, one or more sides may be secured in a flat position.

In some implementations, one and/or both of the outside fabric layers of the baby wrap 100 may be removable from the baby wrap 100. In this way, the outside fabric layer may be replaced and/or washed separately from the baby wrap 100 as a whole. In some implementations, the outside fabric layers may be replaced with and/or covered with an absorbent material.

In some implementations, the baby wrap 100 may be used to transport a nonhuman animal. In some implementations, the baby wrap 100 may be used to transport laundry. In some implementations, the baby wrap 100 may be used to transport any other suitably sized object(s). To this end, after creating a three-sided enclosure as described above with the object(s) inside, a portion of the article including the first opening (e.g., opening 116*a*) of the first handle (e.g., handle 115*a*) and second opening (e.g., opening 116*b*) of the second handle (e.g., handle 115*b*) may be inserted through the fourth opening (e.g., opening 116*c*) of the fourth handle (e.g., handle 115*c*) to create a four-sided enclosure about the object(s). The enclosed object may be carried using the first handle (e.g., handle 115*a*) and second handle (e.g., handle 115*b*).

As used throughout the present specification, the term baby may be used interchangeably with the terms infant and/or child.

Reference throughout this specification to "an embodiment" or "an implementation" or words of similar import means that a particular described feature, structure, or characteristic is included in at least one embodiment of the present invention. Thus, the phrase "in an embodiment" or "an implementation" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. A baby wrap comprising: a piece of material having a left side, a right side, a top side having a first width, and a bottom side having a second width which is substantially equal to the first width, a first side edge extending between the top side and the left side, a second side edge extending between the left side and the bottom side, a third side edge extending between the bottom side and the right side, and a fourth side edge extending between the right side and the top side; wherein the first side edge, second side edge, third side edge, and fourth side edges are tapered; wherein the baby wrap further comprises a first opening positioned adjacent the left side to form a first handle, a second opening positioned adjacent the right side to form a second handle; a third opening positioned adjacent the bottom side to form a third handle; a fourth opening positioned adiacent the top side to form a fourth handle; and wherein the first, second, third, and fourth openings extend through the piece of material.

2. The baby wrap of claim 1 wherein the third opening is configured to allow a portion of the baby wrap including the first opening and second opening to be inserted therethrough.

3. The baby wrap of claim 1 wherein the first, second, and third openings extend vertically.

4. The baby wrap of claim 1 wherein the fourth opening extends horizontally.

5. The baby wrap of claim 1 wherein the piece of material comprises a first layer of fabric and a second layer of fabric.

6. The baby wrap of claim 5 wherein the piece of material further comprises a third layer of fabric.

7. The baby wrap of claim 6 wherein at least one layer of fabric is removable.

8. The baby wrap of claim 6 wherein the third layer of fabric is padding.

9. The baby wrap of claim 1 further comprising at least one elongated attachment wherein one end of the at least one attachment is removably attached to at least one side of the baby wrap.

10. The baby wrap of claim 1 wherein the piece of material further comprises one or more layers of mesh fabric.

11. The baby wrap of claim 1 wherein the piece of material further comprises a pocket.

12. A method of using the baby wrap of claim 1, the method comprising: gathering together the first handle and the second handle; pulling the third handle towards the gathered first handle and second handle; inserting a portion of the baby wrap including the first opening of the first handle and second opening of the second handle through the third opening of the third handle.

13. The method of claim 12 further comprises inserting a user's fingers through the first opening of the first handle and the second opening of the second handle.

14. The method of claim 12 further comprising spreading the baby wrap out on a surface and placing a baby on the baby wrap.

15. The method of claim 12 further comprising spreading the baby wrap out on a surface and placing at least one inanimate object on the baby wrap.

16. The method of claim 12 further comprising spreading the baby wrap out on a surface and placing a non-human animal on the baby wrap.

17. The method of claim 12, the method further comprising: grasping the fourth handle by inserting a user's fingers through the fourth opening and lifting the top side of the baby wrap.

18. The method of claim 12 further comprising: inserting a portion of the baby wrap including the first opening of the first handle and second opening of the second handle through the fourth opening of the fourth handle.

19. The method of claim 13 further comprises removing the user's fingers from the first opening of the first handle and the second opening of the second handle and pulling the portion of the baby wrap back through the third opening of the third handle.

* * * * *